United States Patent [19]

von Ruden

[11] 4,420,189

[45] Dec. 13, 1983

[54] APPARATUS FOR ATTACHING TO EARTH WORKING EQUIPMENT

[75] Inventor: Dennis von Ruden, Owatonna, Minn.

[73] Assignee: General Equipment Co., Owatonna, Minn.

[21] Appl. No.: 262,454

[22] Filed: May 11, 1981

[51] Int. Cl.[3] ..... E01C 23/09

[52] U.S. Cl. ..... 299/40; 172/778; 37/117.5

[58] Field of Search ..... 299/40; 172/777, 778; 37/117.5

[56] References Cited

U.S. PATENT DOCUMENTS

| | | | |
|---|---|---|---|
| 2,536,308 | 1/1951 | Pierce | 172/778 |
| 3,261,643 | 7/1966 | Moench | 172/778 X |
| 3,355,214 | 11/1967 | McClure | 299/40 |
| 3,743,358 | 7/1973 | Guest | 299/40 |
| 3,864,793 | 2/1975 | Guest | 37/117.5 X |
| 3,885,833 | 5/1975 | Lemteux | 299/36 |
| 4,076,314 | 2/1978 | Dodich | 299/40 |

*Primary Examiner*—Ernest R. Purser

*Attorney, Agent, or Firm*—Merchant, Gould, Smith, Edell, Welter & Schmidt

[57] ABSTRACT

An apparatus (20) for attachment to earth working equipment (10). The apparatus (20) is illustrated with a cutting wheel (21) rotatably supported about a horizontally extending axle (22). The apparatus (20) has a support structure (33) with a pair of parallel plates (33) which are generally G-shaped defining a slot (34) with a pair of bucket engaging edges (36) for engagement with a cutting edge (42) of a backhoe bucket (13) or like equipment. The support structure (23) is attached to the backhoe bucket (13) by the clamping action of a pair of counter-threaded screws (24) retained in a pivotable plate (27) and aligned above a pair of arcuate pivot blocks (25).

8 Claims, 6 Drawing Figures

APPARATUS FOR ATTACHING TO EARTH WORKING EQUIPMENT

TECHNICAL FIELD OF THE INVENTION

The present invention relates to the field of earth working apparatus and attaching devices of same to earth working equipment, and more particularly, to asphalt cutter devices for attachment to a backhoe bucket or such similar device.

BACKGROUND OF THE INVENTION

Frequently it is necessary to remove asphalt for road work purposes or to allow the digging of a trench for the installation or repair of utility lines such as water, sewer, telephone, and electrical. Procedures and apparatus for performing this task have been long known in the prior art.

However, in an attempt to improve upon the existing art, various disclosures of which U.S. Pat. No. 3,743,358 (Guest) is representative, have revealed portable asphalt cutters for attachment to motorized vehicles. The asphalt cutters include a cutting disc or wheel, a support structure, and a clamping mechanism for attaching the asphalt cutter to the motorized vehicle. This art uses existing equipment and allows the asphalt cutter to be attached at the work site when needed.

A major problem with the attaching of an asphalt cutter to a backhoe bucket or the like has been the tendency of the clamping mechanism to loosen upon being subjected to the vibratory and jarring forces frequently encountered while cutting asphalt. Consequently, operators must periodically stop their work and retighten or reposition the asphalt cutter. Such interruption results in significant amounts of delay and loss of productivity.

Single screw attaching devices, representative of the prior art, illustrate this problem. A single screw is used to overcome the loosening forces of jarring and vibration. After a period of use, the screw is loosened and the earth working tool or asphalt cutter is no longer held firmly in place. The present invention overcomes this problem by use of a novel clamping mechanism.

SUMMARY OF THE INVENTION

The present invention relates to an apparatus for attachment to earth working equipment. The apparatus includes a tool and means for supporting the tool. The apparatus further includes means for attaching the support means to a wall mounted on the earth working equipment. The attaching means includes a pair of counter-threaded screws for forcing against the wall to frictionally retain the support means in a stationary position relative thereto.

In a preferred embodiment, an asphalt cutter apparatus is illustrated for attachment to a backhoe bucket having a bottom wall with a cutting edge. The bottom wall of the backhoe bucket has an upper and a lower surface. The asphalt cutter apparatus has a cutting wheel for cutting asphalt. The cutting wheel is supported by a horizontally extending axle. The asphalt cutter apparatus has a support structure with a pair of parallel spaced plates attached to the axle and to the bucket. The support structure is attached to the bottom wall of the bucket by a clamping mechanism. The clamping mechanism includes a pair of counter-threaded screws for engaging the upper surface of the bottom wall and a pair of cylindrical pivot blocks for engaging the lower surface of the bottom wall. The counter-threaded screws are threaded through a pivot plate which rotates with a laterally extending pivot pin rotatably retained by the parallel spaced plates above the upper surface of the bottom wall.

The present invention is particularly advantageous due to its capability of resisting the jarring and vibratory loosening forces encountered while working earth, thereby enabling it to retain its grip or position for significant periods of time. The counter-threaded screws cancel or negate the loosening forces since a loosening force on one counter-threaded screw has a tightening or opposite effect on the other counter-threaded screw. In addition, the counter-threaded screws make flush contact with the upper surface of the bottom wall thereby maximizing the frictional forces which oppose the loosening forces.

These and various other advantages and features of novelty which characterize the invention are pointed out with particularity in the claims annexed hereto and forming a part hereof. However, for a better understanding of the invention, its advantages, and objects obtained by its use, reference should be had to the drawings which form a further part hereof, and to the accompanying descriptive matter, in which there is illustrated and described a preferred embodiment of the invention.

BRIEF DESCRIPTION OF THE DRAWINGS

In the drawings, in which like reference numerals and letters indicate corresponding parts throughout the several views.

DETAILED DESCRIPTION OF THE INVENTION

Figure 1:
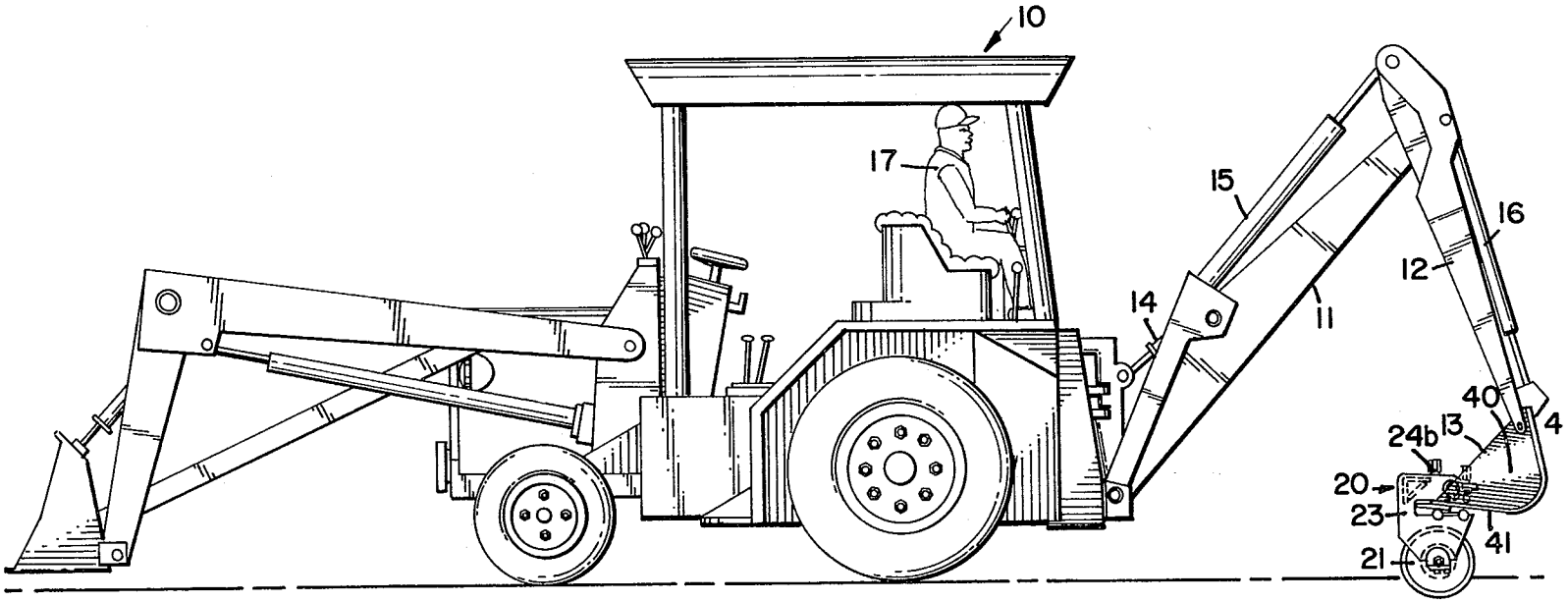
FIG. 1 is a side view of an asphalt cutter apparatus, in accordance with the present invention, utilized on a backhoe bucket.

Referring now to the drawings, there is shown in FIG. 1 an earth working machine or motorized vehicle 10 which is more specifically a backhoe with an upwardly extending arm 11 pivotally connected at its lower end to the vehicle 10. A downwardly extending arm 12 is connected to the arm 11 at its upper end, and a bucket 13 is connected to the lower end of arm 12. An hydraulic cylinder 14 effects movement of arm 11, an hydraulic cylinder 15 effects movement of arm 12, and an hydraulic cylinder 16 effects movement of bucket 13. Vehicle 10 is shown controlled by an operator 17.

Figure 2:
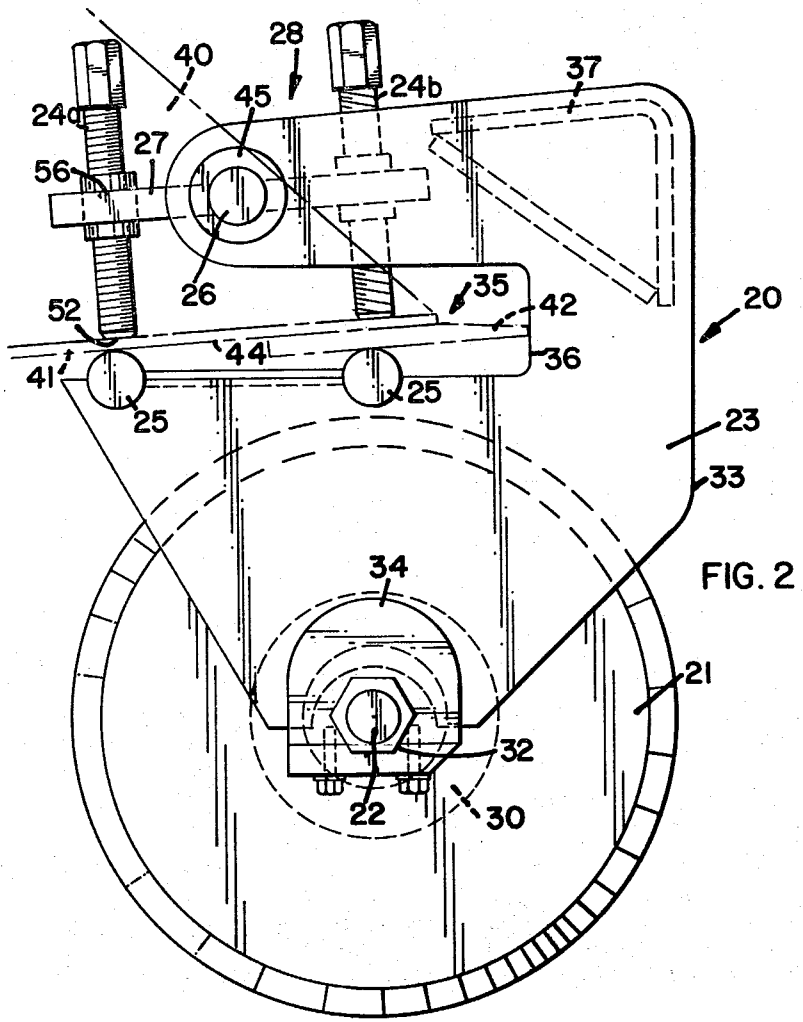
FIG. 2 is a side view of an asphalt cutting apparatus in accordance with the present invention.

Referring to FIGS. 1 and 2, bucket 13 is shown having side walls 40 and a bottom wall 41. Bottom wall 41 commonly has a cutting element 42, an upper surface 43, and a lower surface 44.

Attached to bucket 13 is an asphalt cutter apparatus 20 in accordance with the present invention. It is to be understood, however, that this disclosure, although illustrated by reference to an asphalt cutter apparatus, has general application and may readily be adapted by one skilled in the art. FIG. 2 shows the asphalt cutter apparatus 20 as comprising a cutting wheel 21 on a horizontally extending axle 22. A support structure 23 supports axle 22. Support structure 23 is attached to bucket 13 by a clamping mechanism 28. Clamping mechanism 28 comprises a pair of counter-threaded screws 24*a* and 24*b*, a pair of cylindrical pivot blocks 25, a cylindrical pivot pin 26, and a pivot plate 27.

Figure 3:
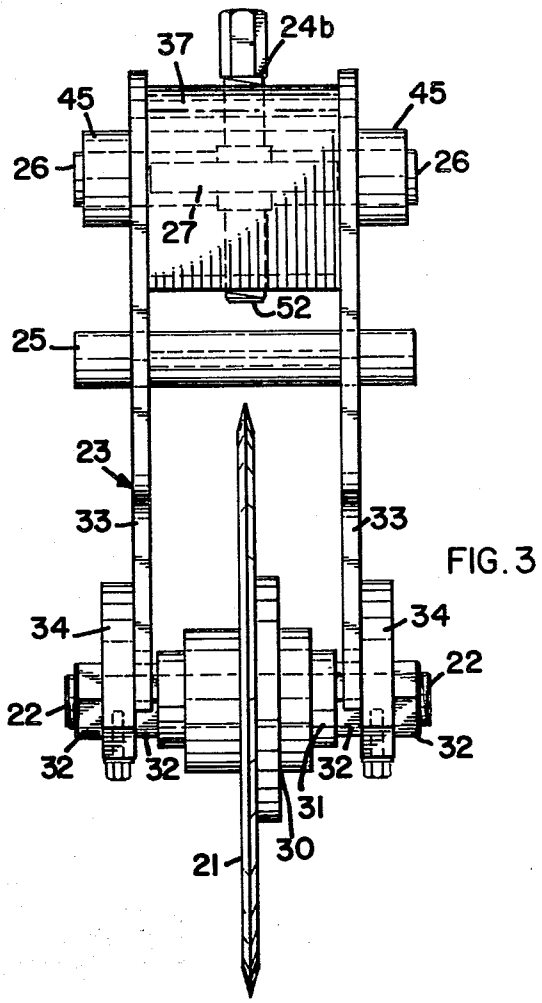
FIG. 3 is an end view of the apparatus in FIG. 2.

More particularly, referring to FIGS. 2 and 3, cutting wheel 21 is rotatively supported by axle 22. Wheel 21 has a wheel hub element 30 which rotates on a bearing element 31 about axle 22. Axle 22 is held stationary by axle nuts 32. Support structure 23, which supports axle 22, has two vertical, parallel, spaced plates 33. Plates 33 are each attached to a U-shaped boss 34 which is clamped around said axle 22 between two axle nuts 32. Plates 33 generally have a G-shape defining a slot 35 generally parallel to axle 22. Plates 33 are reinforced by a gusset element 37 located in the bend of plates 33 above slot 35. Gusset element 37 extends between plates 33, holding them in the spaced, parallel relationship. Slot 35 extends longitudinally above cutting wheel 21 and defines a pair of bucket engaging edges 36 at an end of slot 35 for engagement with cutting edge 42 of bucket 13.

Figure 4:
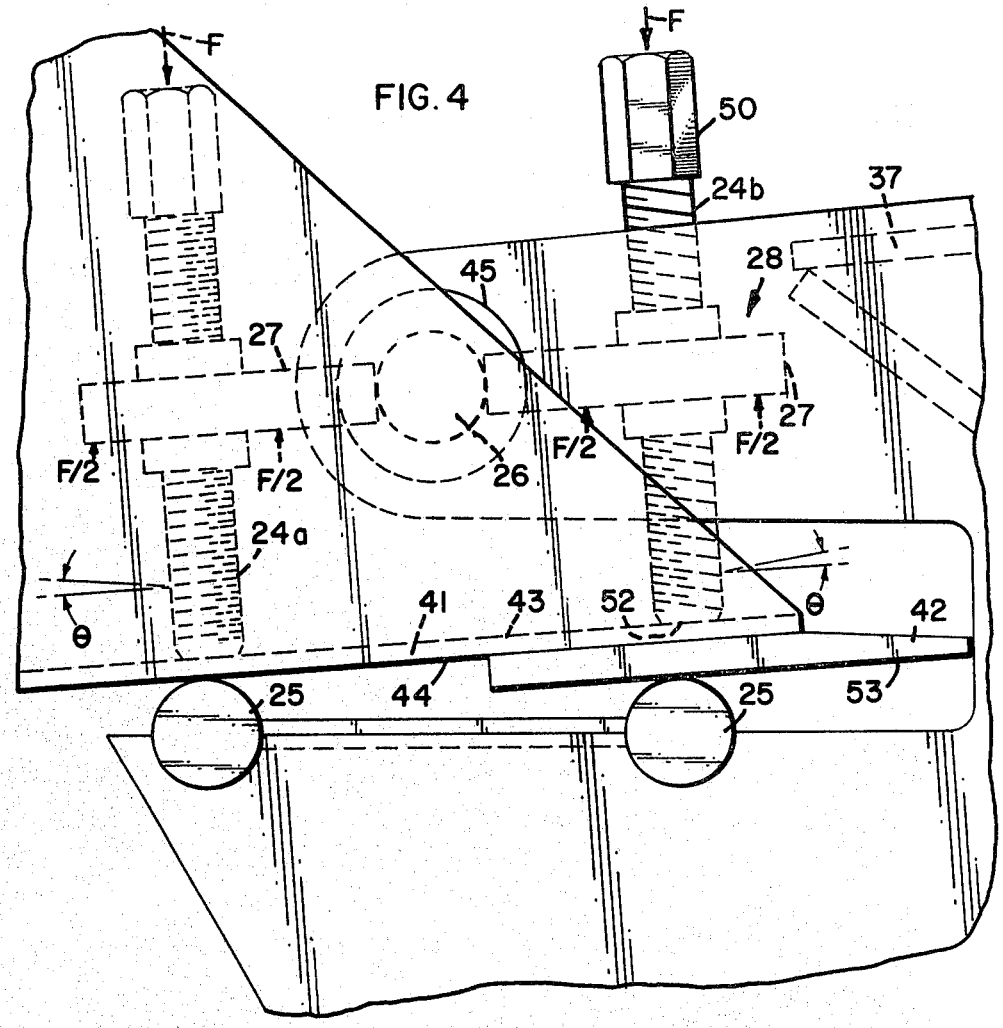
FIG. 4 is a detailed view of the attachment portion of the present invention.

Referring now to FIG. 4, the clamping mechanism 28 is illustrated. Counter-threaded screws 24*a* and 24*b* are shown having a head portion 50 and a shank portion 51. Shank portion 51 has a relatively flat distal end 52 for forcibly engaging upper surface 43 of bottom wall 41. Counter-threaded screws 24*a* and 24*b* have a threaded helix angle which is the same for each. One counter-threaded screw 24*b* has left-handed threads and the other counter-threaded screw 24*a* has right-handed threads.

A pair of cylindrical pivot blocks 25 located below slot 35 are attached to parallel plates 33 for contacting either lower surface 44 of bottom wall 41 or the lower surface 53 of cutting element 42. Cylindrical pivot blocks 25 are aligned directly beneath counter-threaded screws 24*a* and 24*b* and extend laterally, being approximately parallel to axle 22.

A laterally extending cylindrical pivot pin 26, which is approximately parallel to axle 22, is rotatably retained by the parallel spaced plates 33 above slot 35. A boss 45 is located in each of the parallel spaced plates 33 to provide reinforcing support for the pivot pin 26. Pivot pin 26 pivots about horizontal axis 46.

A pivot plate 27 extends approximately equally from opposite sides of said pivot pin. Pivot plate 27 has two threaded openings 56 centered between plates 33 and equally spaced on either side of said pivot pin 26 for passage therethrough of counter-threaded screws 24*a* and 24*b*. Pivot plate 27 rotates with said pivot pin 26 to allow the flat distal ends 52 of counter-threaded screws 24*a* and 24*b* to make flush contact with upper surface 43 of bottom wall 41, thereby maximizing frictional contact between counter-threaded screws 24*a* and 24*b* and bottom wall 41.

In operation, the asphalt cutter apparatus 20 is transported to the work site. The apparatus 20 is attached to the bucket 13 of a motorized vehicle 10, like a backhoe, so that the bottom wall 41 of bucket 13 is positioned in slot 35 such that the bucket engaging edges 36 of slot 35 engage cutting edge 42 of bucket 13. Counter-threaded screws 24*a* and 24*b* are then torqued equally until flat distal ends 52 make flush contact with the upper surface 43 of bottom wall 41 and bottom wall 41 is firmly clamped by counter-threaded screws 24*a* and 24*b* engaging the upper surface 43 and pivot blocks 25 engaging the bottom surface 42.

Figure 5A:
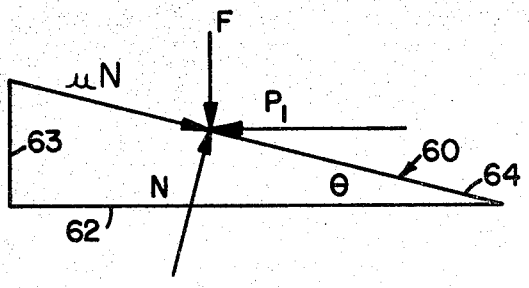
FIGS. 5*a* and 5*b* are geometric representations of forces acting on the attachment portion of FIG. 4.
Figure 5B:
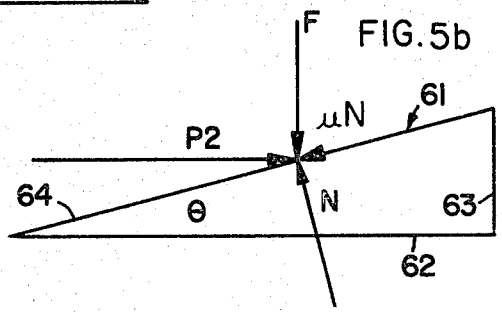

The superior performance of the present invention is apparent when considering the previously unknown advantages described hereinafter. FIGS. 5*a* and 5*b* schematically illustrate the geometry of the counter-threaded screws 24*a* and 24*b*. Screws 24*a* and 24*b* have equal, but opposite, thread helix angles $\theta$. Triangles 60 and 61 represent the geometry of a single thread in each screw 24*a* and 24*b*. Hypotenuse 64 represents the unraveled length of one thread turn. Base 62 represents the mean thread diameter of screws 24*a* and 24*b*, and height 63 represents the amount of axial advance of a thread edge during one complete turn about the circumference of screws 24*a* and 24*b*.

Force vector diagrams are schematically superimposed on triangles 60 and 61. The vertical axial force F represents the force each thread of screws 24*a* and 24*b* applies to wall 41. An equal but opposite normal force N counteracts axial force F. Normal force N, however, acts perpendicular to the thread surface represented by hypotenuse 64 in the triangles 60 and 61. The frictional force uN acts parallel to a thread surface in a generally opposite direction to any force tending to turn screws 24*a* and 24*b*; such forces are represented in FIGS. 5*a* and 5*b* by $P_1$ and $P_2$.

It is most instructive to consider the resolution of forces along the horizontal axis of the force vector diagram, wherein the horizontal axis is parallel with the direction of forces $P_1$ and $P_2$. Thus, $$P_1 - N \sin\theta - uN\cos\theta = 0$$

$$N \sin\theta + uN\cos\theta - P_2 = 0$$

That is, for jarring, vibrating, or other loosening forces to disturb the clamping arrangement of cutter 20 to wall 41, forces $P_1$ and $P_2$ would have to exceed the following:

$$P_1 = N \sin\theta + uN\cos\theta$$

$$P_2 = N \sin\theta + uN\cos\theta$$

Thus, the greater the value of the normal force N and the greater the value of the frictional coefficient u, the greater forces $P_1$ and $P_2$ must be in order to disturb the equilibrium. It is common engineering knowledge that the normal force N is controlled by the tightness with which screws 24*a* and 24*b* are torqued. It is also known that the frictional coefficient u increases with surface area. The present asphalt cutting apparatus 20 is particularly advantageous, then, since screws 24*a* and 24*b* are retained in plate 27 which may pivot so as to align the flat distal ends 52 of screws 24*a* and 24*b* flush with the upper surface 43 of wall 41. In this fashion, contact area between screws 24 and upper surface 43 is maximized, and frictional coefficient u is maximized.

Another particularly advantageous feature of the present invention is that screws 24*a* and 24*b* have equal thread helix angles with oppositely-directed slopes. This feature results in vector force diagrams which are mirror images of each other. In mathematical terms, as seen from the equations listed above, this results in the following equation:

$$P_1 = -P_2$$

Thus, when a loosening force, like $P_2$, acts to loosen one screw, a force of the same magnitude acts negatively with respect to the other screw and, consequently, actually tightens the other screw. Thus, counter-threaded screws 24*a* and 24*b* as assembled in accordance with the present invention operate to neutralize all loosening forces. Hence, if the present asphalt cutter apparatus 20 is tightened such that screws 24*a* and 24*b* are equally and firmly torqued, apparatus 20 will not loosen under vibratory or forward or rearward motion.

It is to be understood, however, that even though these numerous characteristics and advantages of the invention have been set forth in the foregoing description, together with details of the structure and function of the invention, the disclosure is illustrative only, and changes may be made in detail, especially in matters of shape, size, and arrangement of parts, within the principle of the invention, to the full extend indicated by the broad general meaning of the terms in which the appended claims are expressed.

What is claimed is:

1. An apparatus for attachment to earth working equipment, comprising:

(a) a tool;

(b) means for supporting said tool; and (c) means for attaching said support means to a wall mounted on said earth working equipment, said (attaching) attachment means including means for contacting a first surface of said wall and a pair of counter-threaded screws for forcing a second surface of said wall to frictionally retain and clamp said support means in a stationary position relative thereto whereby a force tending to loosen a first threaded screw of said pair simultaneously tightens a second counter-threaded screw of said pair thereby keeping said apparatus attached tightly to said wall.

2. An apparatus in accordance with claim 1, wherein said contacting means includes a pair of arcuately shaped piovot blocks for contacting the first surface of said wall whereby said wall is grasped between said counter-threaded screws and said pivot blocks.

3. An apparatus in accordance with claim 1, wherein said counter-threaded screws have a substantially equal thread helix angle, whereby when said counter-threaded screws are torqued equally, said screws exert equal but opposite frictional forces at said second surface enabling said screws to resist loosening due to vibratory forces.

4. An earth working apparatus for attachment to a backhoe bucket or the like, said bucket having a bottom wall, said apparatus comprising:

(a) a tool;

(b) means for supporting said tool; and (c) means for attaching said support means to said backhoe bucket, said attaching means including a pair of arcuately shaped pivot blocks for contacting a lower surface of said bucket bottom wall, said attaching means further including self-adjusting means for clamping said bucket bottom wall tangentially to said pivot blocks, thereby holding said apparatus fixed relative to said bucket.

5. An apparatus for attachment to an earth working machine, comprising:

(a) a structural means for holding an earth working tool, said structural means including a pair of arms defining a slot therebetween for fitment about a wall mounted on said earth working machine; and, (b) means for attaching said structural means to said wall, said attaching means including a pair of counter-threaded screws for forcing on one side of said slot against a first surface of said wall to pull said arms from a second side of said slot against a second side of said wall whereby a force tending to loosen a first threaded screw of said pair simultaneously tightens a second counter-threaded screw of said pair thereby keeping said apparatus attached tightly to said wall.

6. An apparatus for attachment to a backhoe bucket or the like having a bottom wall, said apparatus comprising:

(a) a tool;

(b) means for supporting said tool, said support means comprising a pair of spaced parallel plates which are generally G-shaped to define a slot, said slot for receiving said bottom wall of said bucket; and (c) means for attaching said support means to said bottom wall of said backhoe bucket, said attaching means comprising a pair of counter-threaded screws, a pair of cylindrical pivot blocks for contacting said backhoe bucket on an opposite side of said bottom wall from said counter-threaded screws, said cylindrical pivot blocks being directly aligned in clamping relationship beneath said counter-threaded screws, and means for pivotably holding said screws relative to said pivot blocks.

7. An apparatus in accordance with claim 6 wherein said screws have a threaded shank with a relatively flat distal end for forcibly engaging an upper surface of the bottom wall of said bucket, and wherein said holding means includes a pivot pin, said holding means further including a pivot plate extending equally on opposite sides of said pivot pin, said pivot plate having threaded openings therein equally spaced from said pivot pin for passage therethrough of said screws, whereby said pivot plate rotates about said pivot pin generally allowing said flat distal ends of said screws to make flush contact with the upper surface of said bucket bottom wall, thereby maximizing the frictional contact between said distal ends and said bottom wall.

8. An asphalt cutter apparatus for a backhoe bucket having a bottom wall with a cutting edge, said bottom wall having an upper and a lower surface, said asphalt cutting attachment apparatus comprising:

(a) a cutting wheel for cutting asphalt;

(b) a horizontally extending axle for rotatably supporting said cutting wheel;

(c) a support structure for said axle, said support structure comprising a pair of parallel spaced plates attached to said axle, said plates being generally G-shaped and defining a slot generally parallel to said axle, said parallel plates defining a pair of bucket engaging edges at an end of said slot for engagement with the cutting edge of said bucket;

(d) a pair of counter-threaded screws, each having a head portion and a shank portion including a relatively flat distal end for forcibly engaging the upper surface of said bucket bottom wall, said counter-threaded screws having an approximately equal thread helix angle, whereby when said counter-threaded screws are torqued equally they exert an equal but opposing frictional force at said upper surface, thereby allowing said counter-threaded screws to resist vibratory loosening forces;

(e) a pair of cylindrical pivot blocks, said pivot blocks contacting said lower surface and being aligned directly beneath said counter-threaded screws, whereby said pivot blocks and said counter-threaded screws clamp said support structure to said backhoe bucket;

(f) a cylindrical pivot pin rotatably retained in said parallel, support structure plates, said pivot pin being approximately parallel to said axle; and (g) a pivot plate extending approximately equally on opposite sides of said pivot pin, said pivot plate having threaded openings therein equally spaced from said pivot pin for passage therethrough of said counter-threaded screws, whereby said pivot plate rotates with said pivot pin generally allowing said flat distal ends of said counter-threaded screws to make flush contact with the upper surface of said bucket bottom wall, thereby maximizing the frictional contact between same.

* * * * *

UNITED STATES PATENT AND TRADEMARK OFFICE

CERTIFICATE OF CORRECTION

PATENT NO. : 4,420,189

DATED : December 13, 1983

INVENTOR(S) : Dennis Von Ruden

It is certified that error appears in the above-identified patent and that said Letters Patent is hereby corrected as shown below:

Column 3, line 29, "threaded" should be --thread--.

Column 3, line 30, after "angle" insert --θ--.

Column 4, line 67, "$P_1$=-$P_2$" should be --$\vec{P}_1$=-$\vec{P}_2$"

Column 5, line 18, "extend" should be --extent--.

Column 5, line 28, "(attaching)" should be deleted.

Signed and Sealed this

Tenth Day of April 1984

[SEAL]

Attest:

GERALD J. MOSSINGHOFF

Attesting Officer

Commissioner of Patents and Trademarks